United States Patent [19]

Strimple et al.

[11] 3,994,676

[45] Nov. 30, 1976

[54] METHOD AND APPARATUS FOR PROTECTING BASIC REFRACTORY SHAPES IN A BASIC OXYGEN FURNACE

[75] Inventors: Robert A. Strimple, Hellertown; Dennis M. Balla, Whitehall, both of Pa.

[73] Assignee: Bethlehem Steel Corporation, Bethlehem, Pa.

[22] Filed: May 14, 1975

[21] Appl. No.: 577,370

[52] U.S. Cl. ..... 432/4; 264/30; 266/281; 432/248

[51] Int. Cl.[2] ..... F27D 1/10; F27D 1/14

[58] Field of Search ..... 432/4, 248; 266/36 D, 266/43, 281; 264/30

[56] References Cited

UNITED STATES PATENTS

| | | | |
|---|---|---|---|
| 3,202,732 | 8/1965 | Braun | 264/30 |
| 3,318,723 | 5/1967 | Troell et al. | 264/30 |
| 3,416,779 | 12/1968 | Campbell, Jr. | 266/36 P |
| 3,587,198 | 6/1971 | Hensel | 52/741 |
| 3,832,478 | 8/1974 | Books | 266/43 |

*Primary Examiner*—John J. Camby
*Attorney, Agent, or Firm*—Joseph J. O'Keefe; Charles A. Wilkinson; John S. Simitz

[57] ABSTRACT

Basic refractory shapes in selected critical wear areas of a working lining in a basic oxygen furnace are protected from spalling due to thermal shock during "burn-in" and initial operation of the working lining and during the early part of a furnace campaign. A plurality of securing means comprising relatively thin, elongated, flat, generally rectangular anchors are positioned in selected joints in the working lining during installation. The anchors extend a distance beyond the hot faces of the working lining. A reticulated reinforcing means comprising a metallic grid is fastened to the anchors in spaced relationship to the hot faces. A layer of a pulverulent basic refractory material having a thickness sufficient to cover the anchors and metallic grid is sprayed over the working lining in the critical wear areas. The layer of sprayed material provides an effective insulation over the basic refractory shapes in the critical wear areas during "burn-in" of the working lining in the furnace.

8 Claims, 5 Drawing Figures

METHOD AND APPARATUS FOR PROTECTING BASIC REFRACTORY SHAPES IN A BASIC OXYGEN FURNACE

BACKGROUND OF THE INVENTION

This invention is directed to a method and apparatus for protecting the basic refractory shapes in selected critical wear areas in the working lining of a basic oxygen furnace from early failure due to spalling caused by thermal shock. Specifically, this invention is directed to protecting the basic refractory shapes in critical wear areas such as the trunnion areas of a working lining in a basic oxygen furnace from early failure due to spalling caused by thermal shock during "burn-in" and during the early part of a furnace campaign.

A basic oxygen furnace is comprised of a metallic shell and several layers of basic refractory shapes which serve to protect the shell from the internal environment of the furnace, i.e. the heat and atmosphere generated inside the furnace during the production of a heat of steel. The innermost layer of the basic refractory shapes is called the working lining because it is exposed to the molten metal, heat and gaseous environment formed in the furnace. The working lining is comprised of a plurality of courses of tar bonded, tar bonded-tempered, or tar impregnated basic refractory shapes made from a basic material, such as sea water magnesite, naturally occurring magnesite, dolomite, magnesia and the like. Each of these basic refractory shapes has an outer coating of tar or tar-like carbonaceous material of greater or lesser thickness. Initially the tar on the surface of the brick allows the expansion of the brick thus reducing mechanical stresses which might lead to mechanical spalling. Subsequently the carbon in the tar reduces slag penetration during the steelmaking operation. The working lining is invariably laid-up without the use of mortar.

Prior to using the basic oxygen furnace for refining of raw materials to produce steel, the working lining is "burned-in" to prepare the lining for actual operation in producing steel. The "burn-in" comprises heating the working lining to a high temperature of about 2000° F. (1093° C) at a rate of about 25° F. per minute without a charge of scrap or hot metal in the furnace. The exact rate of heating depends somewhat upon the particular shop practice. The "burn-in" serves in effect to cure the refractories, and in particular the tar material within and between the refractories, to increase the resistance of the refractories to slag penetration and in the case of an untempered or unbonded brick to prevent the refractories from slumping or collapsing during subsequent use of the furnace for the refining of steel. In the process, the tar coating on the exposed faces of the refractories melts and volatilizes exposing the hot faces of the basic refractory shapes to high temperatures. The exposed faces of the basic refractory shapes, generally referred to as the hot faces of the basic refractory shapes, are heated rapidly while the area of the basic refractory shapes immediately behind the hot faces remains relatively cold. A sharp thermal gradient is thus formed between the hot faces and the remainder of the basic refractory shapes. The sharp thermal gradient causes thermal shock in the refractories, which thermal shock frequently causes a portion of the basic refractory shapes to spall. The depth of the spall can involve as little as 2 inches or as much as 5 inches of the outer portions of the basic refractory shapes adjacent to the working faces. Spalling causes a reduction in the total amount of refractory material available to protect the furnace structure in the spalled areas of the working lining. As a result, the full life of the basic refractory shapes in the working lining is not utilized. Even where spalling does not immediately take place incipient or even actual cracks may be induced in the refractories which cracks lead to premature spalling of the refractories.

A more detailed, though still simplified, explanation of the occurrence of spalling caused by "burn-in" of the furnace follows. During burn-in the exposed end or face of a working lining of unplated basic brick, generally referred to as the "hot face", is heated rapidly, while the opposite end of the brick, generally referred to as the "cold face", is heated very slowly. Consequently, there is a large temperature gradient, which is non-linear, between the hot and cold ends of the brick, and the portions of the brick closest to the hot face are relatively hot while the portions closest to the cold face are relatively cold. The non-linear temperature gradient causes differential expansion of the brick giving rise to differential stresses in the refractories. When such stresses exceed the strength of the brick cracking occurs at varying distances behind the hot face, and severe cracks cause portions of the hot end of the brick to break away. This breaking or cracking action is referred to as "spalling". Obviously, the performance of a severely cracked or spalled brick is substantially poorer than the performance of a similar undamaged brick. The brick damaged by cracking tends to wear faster for a variety of reasons. The most obvious reasons are the reduced thickness of the brick, slag penetration into the cracked areas, additional spalling due to temperature cycling, and the like. However, even though spalling is not evident a certain amount of thermal shock damage will occur during accepted "burn-in" practices. A typical brick working lining is about 36 inches thick and spalling of the brick may significantly reduce its thickness during "burn-in". Obviously a brick of reduced thickness will not wear as well as an undamaged brick of full thickness.

Laboratory studies have confirmed that considerable damage occurs to refractories during "burn-in" even when spalling is not visibly evident. Lining bricks that were heated in the laboratory at normal plant "burn-in" rates of 25° F/minute suffered up to a 65% loss in strength and cracking up to 5 inches in depth from the hot face of the brick. Further testing showed that by reducing the heat-up rate to 5° F/minute it is possible to retain twice as much strength in the bricks as with the 25° F/minute rate.

Although laboratory studies thus demonstrated the value of more moderate heat-up rates, there are other considerations in "burning-in" a furnace. For example, lowering the heat-up rate to 5° F/minute would often adversely affect less expensive refractory bricks which may be used in some portions of the furnace though not throughout a furnace lining. Moreover, with a slower heatup rate, more production time is lost during "burn-in". Four to six heats could be tapped in the extra time it would take to heat-up a lining at a rate of 5° F/minute as opposed to a 25° F/minute heat-up. Given these practical considerations it is evident that some alternative method of reducing the heat-up rate in localized high-wear areas, such as for example the trunnion areas, while maintaining an overall heat-up rate of about 25° F/minute in a basic oxygen vessel is required.

The basic refractory shapes in the hearth or dished bottom of the furnace are customarily protected from cyclic changes in temperature during operation of the furnace and from errosion of the refractories by the hot metal by reason of the slag retained in the bottom of the furnace between heats. The refractory shapes or bricks in the hearth thus do not tend to wear as rapidly as other basic refractory shapes in the working lining. The basic refractory shapes at the slag line are subjected to severe conditions because of the acid character of the early slag. However, these basic refractory shapes are protected by the carbon contained in the refractories and by a coating of basic slag formed later in the steelmaking process. Other basic refractory shapes in the furnace are coated with the basic slag by "rocking" the basic oxygen furnace on its trunnions after tapping the molten steel, but while a substantial amount of basic slag remains in the basic oxygen furnace. However, the basic refractory shapes of the working lining in the trunnion areas of the furnace and also in the cone areas of the furnace on the drive and idler side cannot be effectively coated with the basic slag because the conventional basic oxygen furnace cannot be turned so that the protective slag flows into these areas. Hence, the basic refractory shapes in these areas, i.e. the trunnion areas in particular and also the referred to cone areas, are more susceptible to early failure than the other basic refractory shapes in the furnace. Any cracks or incipient cracks occurring early in a campaign or early in the furnace use in the critical wear areas can easily lead to later spalling and excessive erosion in these areas. In those areas of the furnace in which the refractories can be protected by varous means during the making of a heat of steel in the furnace and particularly where the exposed surfaces of the refractories can be coated with a heavy layer of slag and especially with a basic magnesia containing slag, on the other hand, the early damage caused by incipient cracks and the like can to a large extent be effectively counteracted by such later protection. It is, therefore, essential that the basic refractory shapes in the critical wear areas be protected from excessive early erosion or corrosion or other early damage, such as incipient cracking of the refractories. Efforts, such as spraying the hot faces of the basic refractory shapes with a basic refractory material either prior to or immediately after "burn-in", have not proven to be entirely successful in protecting these areas. Spraying the hot faces prior to "burn-in" has not helped because the tar coating of the refractories melts during "burn-in" and any basic refractory material which has been sprayed on the refractories immediately falls away from the hot faces. Spraying after "burn-in", on the other hand, does nothing to prevent spalling due to thermal shock and resulting incipient cracking caused during "burn-in" and also during the early part of a furnace campaign since it takes several heats usually before a layer of spray material can be made to adhere to the furnace wall. There has been, therefore, a need for a simple, effective, yet inexpensive method of protecting the hot faces of the basic refractory shapes in critical wear areas, e.g. the trunnion areas in particular, and also in the drive and idler cone areas of the working lining in a basic oxygen furnace from thermal shock and spalling during "burn-in" and the early part of a furnace campaign.

It is the object of this invention to provide a method and apparatus for protecting the basic refractory shapes in critical wear areas of a working lining of a basic oxygen furnace from thermal shock and spalling during "burn-in" and the early part of a furnace campaign, which are relatively simple and inexpensive and which will alleviate the problems noted above.

It is a further object of this invention to provide a method for protecting the basic refractory shapes of a working lining in the trunnion areas of a basic oxygen furnace during "burn-in" and the early part of a furnace campaign, which method includes inserting a plurality of anchors in selected joints between the basic refractory shapes in a working lining during installation with one end of the anchors extending beyond the hot faces of the basic refractory shapes, securely fastening a reticulated reinforcing means, such as a metallic grid to the anchors, in spaced relationship to the hot faces of the basic refractory shapes and prior to "burn-in" spraying a coating of a pulverulent basic refractory material over the hot faces of the basic refractory shapes to a depth whereby the anchors and the reticulated reinforcing means are completely covered by the sprayed basic refractory material.

SUMMARY OF THE INVENTION

In the method of the invention, a plurality of basic refractory shapes are laid-up to form the working lining in a basic oxygen furnace. A plurality of flat, relatively thin, generally rectangular metallic anchors having a thin deformable "finger" and an open generally rectangular slot formed near one end thereof, are vertically aligned in some of the joints in the courses of the basic refractory shapes in the critical wear areas, for example the trunnion areas of the furnace during installation of the working lining. The anchors are positioned so that the deformable "finger" and slot extent a distance beyond the hot faces of the basic refractory shapes. The number of anchors used is predicated on the area desired to be protected. A reticulated reinforcing means, such as a metallic grid of predetermined length and width is securely fastened to the anchors in spaced relationship with the hot faces of the basic refractory shapes. Prior to "burn-in" of the basic oxygen furnace a pulverulent basic refractory material is sprayed over the anchors and reticulated reinforcing means to cover the predetermined areas of the working lining in the critical wear areas, for example, in trunnion areas of the working lining. The layer of pulverulent basic refractory material sprayed over the hot faces of the basic refractory shapes is applied sufficiently thickly to completely cover both the anchors and the reticulated reinforcing means. The sprayed pulverulent basic refractory material forms an insulation over the hot faces of the basic refractory shapes and prevents rapid increase in temperature of the hot faces during "burn-in" and the early part of a furnace campaign thereby reducing spalling or incipient cracking of the refractories due to thermal shock.

PREFERRED EMBODIMENT OF THE INVENTION

Figure 1:
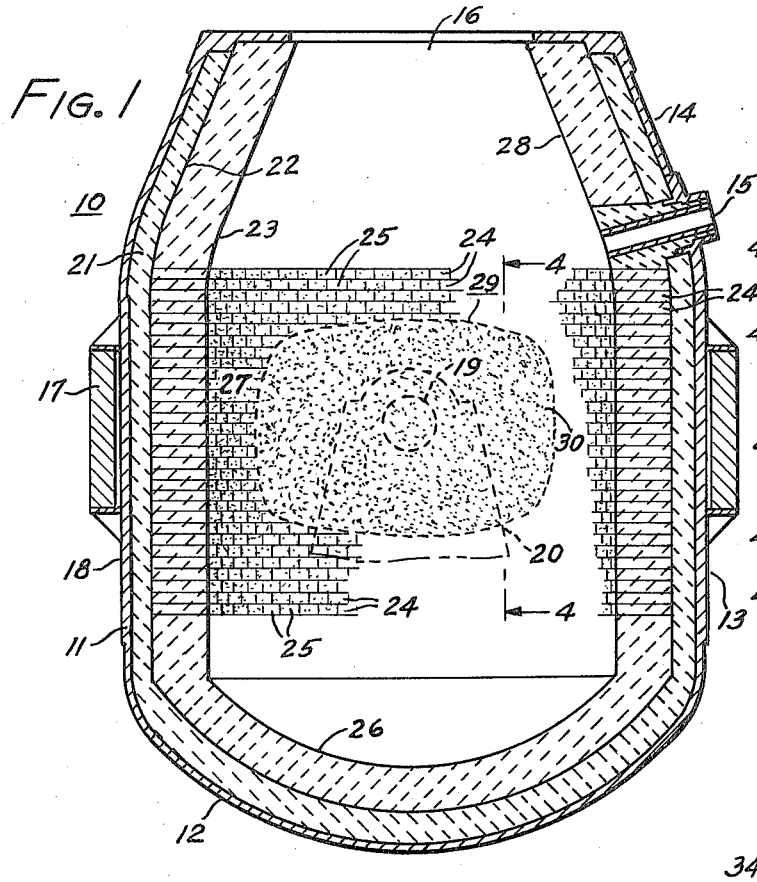
FIG. 1 is a cross-sectional view of a basic oxygen furnace incorporating the arrangement of the invention including a layer of pulverulent basic refractory material sprayed over the hot faces of the basic refractory shapes in the working lining in the trunnion areas of the furnace.

We have found that it is possible to protect the hot faces of basic refractory shapes used to lay-up the working lining of a basic oxygen furnace from a rapid increase in temperature during "burn-in" and the early part of a furnace campaign, to thereby prevent early spalling or incipient cracking of the basic refractory shapes due to thermal shock. The hot faces of the refractories are insulated from the elevated temperatures in the basic oxygen furnace during "burn-in" and the early part of a furnace campaign by spraying a layer of a pulverulent basic refractory material which is compatible with the basic material in the basic refractory shapes over the hot faces of the basic refractory shapes prior to "burn-in". The pulverulent basic refractory material can be magnesia, magnesite, dolomite and the like in the form of a sprayable slurry. The sprayed pulverulent basic refractory material is held in place during "burn-in" and usually for several subsequent heats in the early portion of the furnace campaign by a metallic reinforcing arrangement comprising a plurality of anchors and a reticulated reinforcing means, such as a metallic grid or metallic wire mesh and the like securely fastened to the anchors in spaced relationship with the hot faces of the basic refractory shapes in the working lining. The basic refractory shapes used in laying-up the working lining are made from refractory materials such as sea water magnesite, naturally occurring magnesite, magnesia, dolomite and the like and can be tempered, tar bonded and tar-coated or tar-impregnated and tar-coated as is well known in the art.

The pulverulent spray material is held against the surfaces of the refractory shapes by the reinforcing material. It might be thought that the spray material would prevent the tar coating from vaporizing or being burned from the surfaces of the lining of the furnace during "burn-in" and that the refractory material would consequently interfere with the curing of the lining. It has been found, however, that the refractory spray material, although acting as an effective insulator against heat, is sufficiently porous so that vaporizable material can pass from the underlying refractory surface through the refractory spray material and escape during "burn-in" into the furnace usually being burned at the outer surface of the refractory spray material. The curing of the refractories is thus not retarded and the refractory shapes are ready for exposure to the internal furnace environment during the refining of a heat of steel without excessive penetration of slag into the refractories or in the case of untempered or unbonded refractories slumping or collapse of the refractories. While not presently proven, furthermore, it appears that the sprayed refractory layer may not only allow curing of the underlying refractory during "burn-in" without allowing thermal shock to occur and thus avoid the formation and propagation of incipient cracks in the component refractories of the furnace, but may also increase the coking or deposition of carbonaceous material in the interstices between basic refractory particles in the basic refractory shapes of the working lining, particularly near the surface. The deposition of such carbonaceous material is advantageous in binding the refractory particles and excluding detrimental slag penetration of the refractory during operation of the furnace.

In these specifications and claims, it must be understood that wherever the term "working lining" is used, we mean a plurality of basic refractory shapes of the type mentioned previously, laid-up with their surfaces contiguous to one another as is well known in the art in a plurality of courses to form a substantially continuous surface exposed to the environment in the basic oxygen furnace and having intervening joints extending generally perpendicularly with respect to the wall of the vessel between the refractory shapes and formed by the contiguous surfaces of the basic refractory shapes. Each basic refractory shape in the working lining has one face known as the hot face because it is exposed to the environment in the furnace. Consequently, the substantially continuous surface of the working lining is made up of a plurality of the hot faces of the basic refractory shapes comprising the working lining.

A furnace campaign comprises a number of consecutive heats, for example, almost 800 to 2000 heats of steel made with one working lining in the basic oxygen furnace and includes any regular intervening maintenance of the working lining, which maintenance may comprise the patching of holes in the working lining with a sprayable basic refractory material or the like. The approximate average of heats customarily obtained in any given shop depends upon the shop's operating practices. Such practices vary from shop to shop throughout the industry. The early part of a furnace campaign can include as many as 12 heats of steel. The furnace will be completely relined at least with respect to the working lining between campaigns in the furnace.

Turning now to FIG. 1, a basic oxygen furnace is shown generally at 10. The basic oxygen furnace 10 comprises an outer metallic shell 11 defining a dished lower section 12, a generally cylindrical barrel section 13 and an upper cone section 14. A tap hole 15, whereby molten steel is tapped from the furnace 10, is provided in the cone section 14. The cone section 14 has an open top 16 through which raw materials can be charged into the furnace 10. A trunnion ring 17 is fastened to the outer surface 18 of the shell 11 and extends around the periphery of the furnace 10. A pair of diametrically opposed trunnions, one of which is shown at 19 in FIG. 4, extend outwardly from the trunnion ring 17. The trunnions 19 are mounted on stanchions, partially shown at 20 in FIG. 4. The trunnions 19 provide a support for the furnace 10 and are a means whereby the furnace 10 can be pivotally tilted so that molten metal can be tapped from the furnace 10. The slag formed in the refining process can also be removed by tilting the furnace. A safety lining 21 comprised of a plurality of basic refractory shapes is laidup against the inner surface 22 of the metallic shell 11. A working lining 23, made of a plurality of horizontal courses 24 of basic refractory shapes 25 having four side surfaces (not shown) and two end surfaces, is laid-up against the safety lining 21. The working lining 23 is so named because the substantially continuous surface of this lining is exposed to the environment in the furnace 10. A plurality of vertical and horizontal joints (identified as 42a and 42b respectively in FIGS. 3 and 4) between the refractory shapes are formed by the contiguous side surfaces of the basic refractory shapes 25. It is very desirable to have a substantially even surface on the working lining with no discontinuities between the surfaces of adjoining refractory shapes or bricks as such an even surface decreases the opportunity for corrosion and erosion of the refractory surfaces. In other words it is very desirable to have the hot faces of all the refractory shapes in the working lining at the same level with no intervening discontinuities or projections so that an overall smoothly contoured surface is presented within the furnace. This is not to say that the bricks in the furnace may not be stepped in many cases in order to form a contour of the furnace lining. Rather it is meant that the levels of the working surfaces of adjacent refractory shape are as close to each other as possible while still using standard shaped refractories and there are no intervening projections or barriers between the shapes.

Because wear conditions are variable in different areas of a lining it has become common practice to incorporate bricks of various thickness and quality into a working lining in an effort to have all portions of such lining last an equal length of time. This practice produces what is referred to as a "balanced lining". It is well known that certain areas are more susceptible than others to spalling although thermal shock damage may occur anywhere in the lining. In a basic oxygen furnace in which the trunnion portions of the working lining are constructed of bricks that are thicker than in other areas and project into the furnace beyond the hot faces of brick surfaces of adjacent areas, thermal shock damage is particularly severe. The furnace shown in the FIGURES does not incorporate such thickened areas but it is not to be inferred from this that the invention would not encompass such a construction.

The working lining 23 comprises a dished bottom portion 26, a barrel portion 27 and a cone portion 28. One of the trunnion areas 29 is outlined by a dotted line. A layer 30 of sprayed basic refractory material, held in place by the apparatus of the invention, is shown in this area.

Figure 2:
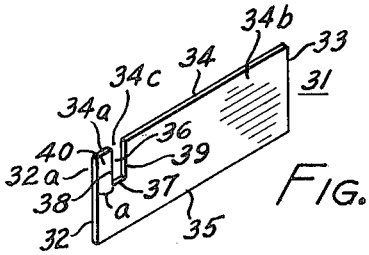
FIG. 2 is a view of one of the anchors used to hold the reticulated reinforcing means in place in the trunnion areas of the working lining of the basic oxygen furnace.

One of the anchors 31 used in the invention is shown in FIG. 2. The anchor 31 is relatively thin and generally rectangular in shape, having two short parallel edges 32 and 33 and two long parallel edges 34 and 35. The edge 35 is continuous but edge 34 is discontinuous and includes a forward portion 34*a*, a rear portion 34*b* and an open portion 34*c* between portions 34*a* and 34*b*. A generally rectangular slot 36 parallel to edges 32 and 33 is formed in the anchor 31 at a predetermined distance, *a*, from the edge 32. The generally rectangular slot 36 is open on one end and comprises one comparatively short edge 37 parallel to open section 34*c* and two comparatively long parallel edges 38 and 39 which are perpendicular to edge 37 and section 34*c*. While slot 36 is shown as being generally rectangular, other geometric shapes wherein the edges 38 and 39 either diverge or converge can be used. The length of edges 38 and 39 can be varied to increase or decrease the depth of the slot 36. A deformable "finger" 40 is formed by the upper portion 32a of short edge 32, edge 38 of the slot 36 and forward portion 34a of edge 34. The distance, a, can be varied to provide a narrow or broad deformable "finger" 40. The length of edges 34 and 35 and consequently the longitudinal length of the anchor 31 can be varied dependent upon the length of the basic refractory shapes in the working lining, the size and weight of the reinforcement which is to be supported and the depth of refractory insulating layer which is to be applied to the hot faces of the refractory shape in the trunnion areas of the furnace. The length of the edges 34 and 35 must be sufficient to insure that the slot 36 and deformable "finger" 40 extend a predetermined distance beyond the hot faces of the basic refractory shapes in the working lining.

Figure 3:
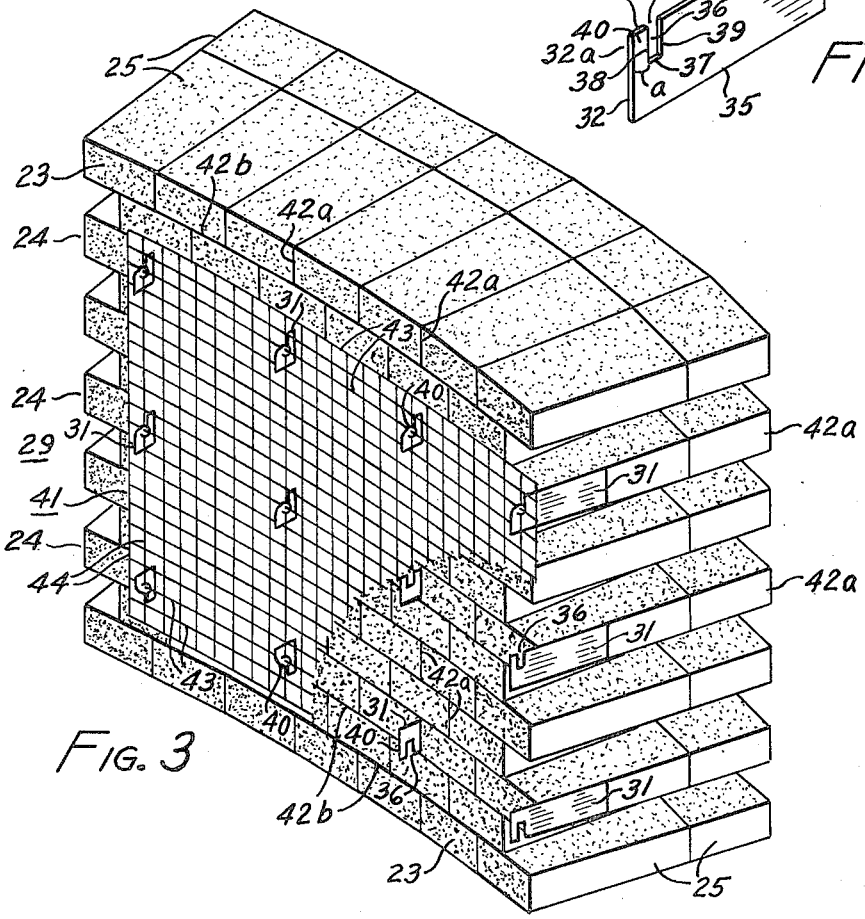
FIG. 3 is an enlarged view of a trunnion area of the working lining in a basic oxygen furnace showing the anchors and a reticulated reinforcing means or metallic grid in place.

FIG. 3 is an enlarged view of the trunnion area 29 of the working lining 23 with anchors 31 and metallic grid 41 having horizontal strands 43 and vertical strands 44 in place to receive the pulverulent sprayable basic refractory material. The apparatus includes a plurality of anchors 31 positioned as shown in selected vertical joints 42*a* of the working lining 23. As shown, the anchors 31 are used in every fourth course 24 in the working lining 23. The anchors 31 can be used in any combination of courses 24, for example, every other course, consistent with the strength required to securely hold the metallic grid 41 in place. The joints between the refractories in which the anchors are placed are, therefore, "selected" in the sense that the anchors are not placed usually in adjacent joints nor particularly abutting each other and that the arrangement and spacing of the anchors is compatible with effective support of the reticulated reinforcement secured to the outer ends of the anchors. In other words the anchors are meant to be spaced a substantial distance from each other as shown rather than being placed so close together as to form almost a continuous anchoring means extending along the individual joints between the refractories. The metallic grid 41 is preferably placed in the vertical slots 36 as shown since the grid is customarily mounted with the vessel in an upright position wherein a major portion of the strain on the anchors is aligned more or less vertically. It will be readily understood, however, that if some alternative construction of anchor was used or if the strain upon the anchors was not generally vertically aligned, that the anchors could have an alternative positioning such as in the horizontal joints. Vertical and horizontal joints as used herein refers to the disposition of the joints while the basic oxygen furnace vessel is in an upright position. The deformable "finger" 40 is coiled around the horizontal members 43 of the metallic grid 41 to securely fasten the metallic grid 41 in place generally parallel to and in spaced relationship with the working lining 23. The anchors 31 in the lowermost positions are aligned with the slot 36 opening downwardly while the anchors in the uppermost positions are aligned with the slot 36 opening upwardly. This is done so that the metallic grid 41 is held conveniently in a taut position. The anchors 31 in the outermost positions or side positions can also be aligned in horizontal joints 42*b* in the working lining with the slots opening outwardly to more securely hold the vertical strands 44 of the metallic grid 41 and thereby provide more rigidity to the metallic grid 41. Such an arrangement adds to the tautness of the reticulated reinforcement, but is not always necessary. Only vertically aligned anchors are shown in the drawings.

Figure 4:
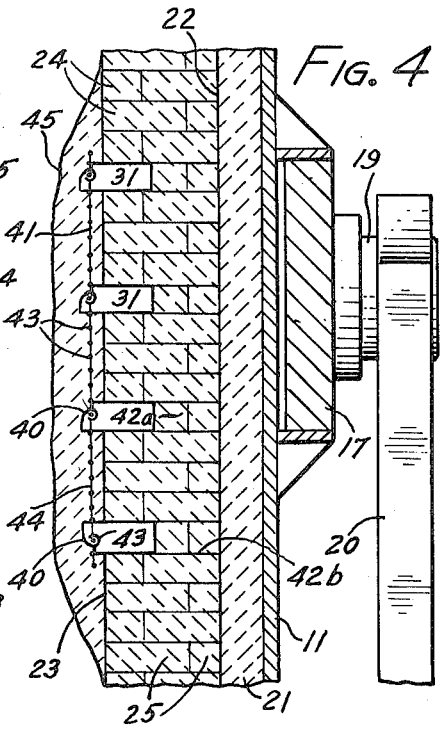
FIG. 4 is a section along 4—4 of FIG. 1 through a trunnion area of a basic oxygen furnace after a layer of a pulverulent basic refractory material has been sprayed in place over the hot faces of the working lining, the anchors and the metallic grid.

Turning now to FIG. 4, a plurality of anchors 31 are shown embedded in the vertical joints 42a of the working lining 23. The metallic grid 41 is in place in the anchors 31. A layer 45 of a sprayed basic refractory material is shown covering the hot faces of the working lining 23. The anchors 31 and the metallic grid 41 are completely embedded in the layer 45 of the pulverulent sprayed basic refractory material. We have found that the layer 45 of the pulverulent sprayed refractory material can be as thin as ¾ of an inch and still provide beneficial insulating effects to prevent rapid temperature increase in the working lining during "burn-in". Thinner layers of the pulverulent basic refractory material, for example ⅝ of an inch and less, may have some insulating effect, but the insulating effect is not sufficient to prevent spalling of the working lining due to thermal shock. Thicker layers can be used, but for economic reasons we prefer to use layers about 5 inches or less in thickness. Five inches of refractory insulation has been found to be sufficient to provide an insulating effect great enough to prevent any substantial thermal shock to the underlying refractory surfaces of a magnitude sufficient to cause a substantial decrease in refractory life. While thicker layers of refractory spray material can be used, they are usually not necessary. Naturally the exact thickness of the refractory spray material applied will depend somewhat upon the actual rate of heating during "burn-in" adopted in a particular shop and the insulating value of the particular spray material used. As set forth above the preferred thickness ranges from ¾ of an inch to 5 inches.

Figure 5:
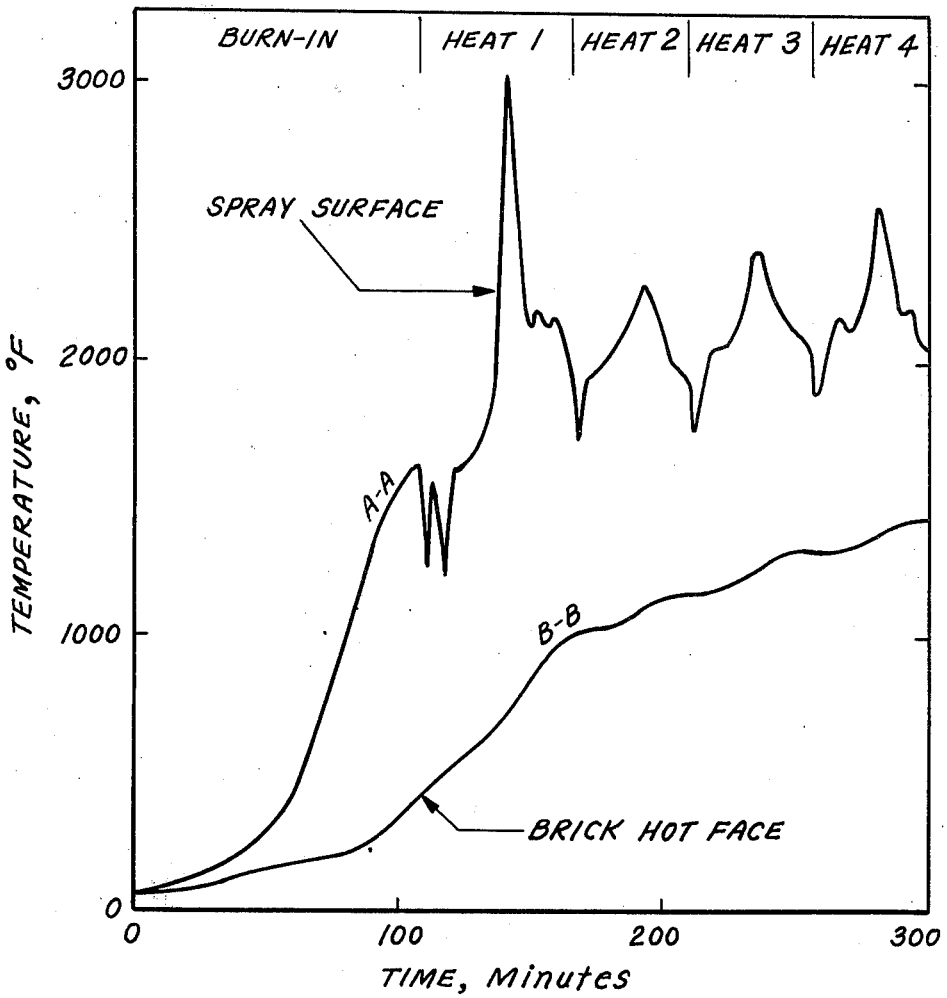
FIG. 5 is a graph showing the temperature profiles of the hot face of the pulverulent basic refractory material sprayed over the working lining in a trunnion area and the hot faces of the basic refractory shapes in the working lining.

In a specific example of the invention, anchors were aligned in every fourth course and in every other vertical joint when installing the working lining in a basic oxygen furnace. A plurality of tar impregnated and tar coated magnesia refractory shapes was laid-up in a 250 ton basic oxygen furnace. During installation a plurality of anchors which were 6 inches long by 2⅞ inches high and 0.0179 of an inch in thickness, having a slot 1¼ inches deep and ¼ of an inch wide spaced ¼ of an inch from one end of the anchors and a deformable finger 1¼ inches long and ¼ of an inch wide, were installed in the vertical joints between the basic refractory shapes in the trunnion areas as shown in FIG. 3. A metallic grid which was 120 inches by 240 inches in size having horizontal and vertical strands was placed in the slots of the anchors. The deformable "finger" was coiled around the horizontal strands to securely attach the metallic grid to the anchors. The metallic grid was positioned a distance of about ¼ of an inch to ¾ of an inch from the hot faces of the basic refractory shapes. A layer of a slurry of pulverulent magnesia material which varied between ¾ of an inch to 1½ inches in thickness and which covered 200 square feet of the working lining was sprayed over the hot faces of the refractory shapes as seen in FIG. 4. The working lining was "burned-in" by heating the furnace to about 2000° F. (1093° C) at a rate of about 25° F. per minute (about 14° C/min). Prior to "burn-in", one thermocouple was inserted into the contact zone between the hot faces in the working lining and the sprayed refractory material and a second thermocouple was placed at the surface of the sprayed pulverulent basic refractory material. The temperatures recorded at two locations during burn-in are shown in FIG. 5. Curve A—A shows the temperature of the surface of the pulverulent sprayed basic refractory material. Curve B—B shows the temperature of the hot face of the working lining. Note that the surface of the sprayed pulverulent basic material increased in temperature from ambient temperature to about 1500° F. (815° C) in about 100 minutes or at a rate of 15° F. (8.3° C) per minute but the hot face of the working lining only increased to about 250° F. (121° C) during the same time or at a rate of 2.5° F. (1.4° C) per minute. The hot face of the working lining did not reach 1500° F. (816° C) until after the fourth heat of steel was produced. Portions of the layer of sprayed pulverulent basic refractory material remained in place during the production of the first four heats of steel. At this point in time, the danger of spalling due to thermal shock was minimal (or reduced substantially to zero). The increase in temperature of the hot face of the working lining was gradual but steady after the first heat of steel had been produced. The basic oxygen furnace was used to produce 1935 heats of steel before it had to be removed from service for reline. Generally the useful life of a working lining in this furnace is about 1750 heats.

Although, we have shown the anchors aligned generally vertically in vertical joints of the working lining as set forth above, the anchors can also be aligned horizontally in horizontal joints. Of course a combination of verticaly aligned and horizontally aligned anchors in vertical joints and horizontal joints, respectively, of the working lining can also be used in the method of the invention. We have shown the use of a metallic grid having horizontal and vertical strands as the reticulated reinforcing means, however, other forms of metallic grids having diagonal strands or strands forming hexagons and the like can be used in the method of the invention. The size of the furnace dictates the size of the trunnion area or other critical wear area which must be protected by the method of the invention. Essentially the area which must be protected is that portion of the furnace which cannot be reached by molten slag during rocking of the furnace between heats to distribute the slag.

While the reinforced sprayed refractory layer of the invention could be applied over almost any portion of the so-called hot face of the furnace and would presumably protect such portion of the furnace lining, during "burn-in" particularly, from possible spalling, it has been found, as explained above, that it is only necessary usually to apply the refractory covering of the invention to the critical wear areas of the furnace or in other words the trunnion areas or certain areas of the cone of the furnace since it is these areas in particular which it has proven very difficult if not impossible to adequately protect during a campaign in the furnace. It has been found, therefore, that if incipient spalling of the refractories in the trunnion areas can be forestalled during the "burn-in" and early portions of the campaign in the furnace that the overall wear of the refractory lining in this portion of the furnace can be made substantially more comparable to the overall wear of the remaining portions of the furnace lining which can be more effectively protected during a campaign in the furnace and a very significant increase in the overall life of the furnace can as a consequence be achieved. It is an ultimate aim in furnace life naturally to have all portions of the furnace wear more or less evenly so that the entire operating portion of the furnace lining will wear out at one time. In this manner there is minimum wastage of refractory material and the most economical furnace operation and refractory use can be achieved. The present invention has been found to be a substantial aid in approaching this ultimate aim.

The anchor sections used in the invention cannot be too massive or extensive because as has been pointed out above the refractory lining of a basic oxygen furnace is invariably laid up without mortar or the like between the component refractory shapes. It is important that the joints between the refractory shapes be very tight in order to avoid attack between the refractory shapes. The insertion of any metallic material between the refractory thus is undesirable, and it is normally desirable, therefore, for the cross sectional area i.e. the breadth and width, of the anchors to be as small as possible compatible with sufficient strength to support the reticulated reinforcing material and the refractory spray material deposited over it. It is particularly undesirable for the anchors to have too extensive a width, i.e. a distance between the edges 34 and 35 as shown in FIG. 2, because the metallic material of the anchor under the oxidizing conditions found in an operating furnace cause the metal to become oxidized and this metallic oxide then may react with the carbon in the refractory shapes of the working lining with a resultant detrimental effect upon the life of the refractory material. It is thus very desirable for the anchors to be as narrow as possible so that they contact a minimum surface area of the adjoining refractory sections.

While we have shown the working lining as comprising two sizes of basic refractory shapes, it must be understood that one size of basic refractory shapes can be used to form the working lining. Likewise it will be understood that while the language of the claims refers to substantially continuous interior refractory surfaces such continuous interior surfaces would include a stepped surface formed from standard refractory shapes. A substantially continuous interior surface would not include a surface having a substantial discontinuity such as a barrier or projection between the various refractory shapes.

We claim:

1. Apparatus for protecting a critical wear area of a working lining in a basic oxygen furnace from thermal shock during "burn-in" and the early part of a furnace campaign, said working lining consisting of a plurality of basic refractory shapes laid-up in a plurality of courses with the hot faces of the basic refractory shapes exposed to the environment in said furnace, comprising:

a. reticulated reinforcing means for retaining a layer of sprayed basic refractory material in place over the hot faces of said basic refractory shapes in said critical wear area, and b. securing means comprising a flat relatively thin, generally rectangular metallic plate having a cross-sectional area as small as possible compatible with sufficient strength to support said reticulated reinforcing means and said layer of sprayed refractory material, and two relatively short edges and two relatively long edges, a deformable finger formed on one end of the metallic plate contiguous with a slot having two comparatively long edges and one comparatively short edge, said short edge being a predetermined distance from one of said relatively long edges of said plate to form the deformable finger for attaching said reticulated retaining means in spaced relationship with said hot faces in said critical wear area.

2. The apparatus as claimed in claim 1 wherein the securing means comprises a flat relatively thin, generally rectangular metallic plate having two relatively short parallel edges perpendicular to two relatively long parallel edges, a generally rectangular deformable finger formed on one end of the metallic plate contiguous with a generally rectangular slot having two relatively long parallel edges and one relatively short edge perpendicular to the relatively long parallel edges, said short edge being a predetermined distance from one of said relatively long parallel edges of said plate.

3. The apparatus as claimed in claim 1 wherein the reticulated reinforcing means is a metallic grid comprising a plurality of generally parallel horizontal strands and a plurality of generally parallel vertical strands generally perpendicular to said horizontal strands and fastened to said horizontal strands.

4. The apparatus as claimed in claim 3 wherein said critical wear area is the trunnion area.

5. A method of extending the operating life of a basic oxygen furnace, wherein a plurality of basic tar-coated refractory shapes are laid up within the basic oxygen vessel to form a substantially continuous even interior refractory surface comprised of cooperating contiguous individual refractory surfaces exposed to the environment interior of said furnace, by improving the equalization of wear of said refractory surfaces during a campaign in said furnace comprising:

a. inserting a plurality of anchors in spaced relationship with respect to each other partially into joints between refractory shapes in critical wear areas of said furnace to secure said anchors to said furnace lining before said refractories of said furnace are exposed to elevated temperatures, each of said anchors comprising a flat relatively thin, generally rectangular metallic plate having a cross-sectional area as small as possible compatible with sufficient strength to support said reticulated reinforcing means and said layer of sprayed refractory material and two relatively short edges and two relatively long edges, a deformable finger formed on one end of the metallic plate contiguous with a slot having two comparatively long edges and one comparatively short edge, said short edge being a predetermined distance from one of said relatively long edges of said plate, b. securing a reticulated reinforcing means to exposed portions of said anchors by means of said deformable fingers in a position such that the reticulated reinforcing means is spaced from said refractory surfaces and the said critical wear areas of the furnace are substantially overlain by said reticulated reinforcing means, c. spraying a layer of pulverulent basic refractory material over said reinforcing means and refractories in the said critical wear areas to a depth sufficient to cover said anchors and reinforcing means and provide an effective insulating layer over said refractories, and d. burning-in said furnace with said pulverulent refractory material maintained in place over said refractories during said "burn-in" period by the reinforcing means.

6. The method of claim 5 wherein the basic refractory shapes are made from at least one material taken from the group consisting of magnesite, magnesia and dolomite.

7. The method of claim 5 wherein said critical wear area is the trunnion area.

8. The method of claim 5 wherein the depth of the layer of the sprayed basic refractory material in step (c) is between about ¾ of an inch to about 5 inches.

* * * * *